US009046256B2

(12) United States Patent
Szprengiel et al.

(10) Patent No.: US 9,046,256 B2
(45) Date of Patent: Jun. 2, 2015

(54) CONNECTOR HAVING A CYLINDRICAL BODY WITH A FLANGE AND AN INTEGRAL INSERT WITH A RECTANGULAR BORE

(71) Applicants: Stanley Szprengiel, Jackson, NJ (US); Viranjitsinh Chudasama, Toms River, NJ (US)

(72) Inventors: Stanley Szprengiel, Jackson, NJ (US); Viranjitsinh Chudasama, Toms River, NJ (US)

(73) Assignee: COMPONENT HARDWARE GROUP, INC., Lakewood, NJ (US)

( * ) Notice: Subject to any disclaimer, the term of this patent is extended or adjusted under 35 U.S.C. 154(b) by 0 days.

(21) Appl. No.: 14/189,493

(22) Filed: Feb. 25, 2014

(65) Prior Publication Data

US 2014/0240971 A1 Aug. 28, 2014

Related U.S. Application Data

(60) Provisional application No. 61/768,757, filed on Feb. 25, 2013.

(51) Int. Cl.

| | |
|---|---|
| ***H01R 13/62*** | (2006.01) |
| ***F21V 23/06*** | (2006.01) |
| ***H01R 33/06*** | (2006.01) |
| ***F21K 99/00*** | (2010.01) |
| ***F21V 21/30*** | (2006.01) |
| *H01R 33/08* | (2006.01) |
| *H01R 33/94* | (2006.01) |
| *F21Y 101/02* | (2006.01) |
| *F21Y 105/00* | (2006.01) |

(52) U.S. Cl.

CPC ..... *F21V 23/06* (2013.01); *H01R 33/06* (2013.01); *F21K 9/17* (2013.01); *F21V 21/30* (2013.01); *H01R 33/0809* (2013.01); *H01R 33/94* (2013.01); *F21Y 2101/02* (2013.01); *F21Y 2105/001* (2013.01)

(58) Field of Classification Search

CPC ..... H01R 27/00; H01R 127/02; H01R 31/06; H01R 33/94

USPC ..... 439/300, 638

See application file for complete search history.

(56) References Cited

U.S. PATENT DOCUMENTS

| | | | | |
|---|---|---|---|---|
| 7,052,171 | B1 * | 5/2006 | Lefebvre et al. | 362/649 |
| 7,387,544 | B1 * | 6/2008 | Hsu | 439/699.2 |
| 7,568,955 | B2 * | 8/2009 | Stoner et al. | 439/699.2 |
| 8,118,447 | B2 * | 2/2012 | Simon et al. | 362/235 |
| 8,299,695 | B2 * | 10/2012 | Simon et al. | 313/318.01 |
| 8,360,599 | B2 * | 1/2013 | Ivey et al. | 362/218 |
| 8,540,401 | B2 * | 9/2013 | Simon et al. | 362/373 |
| 8,764,221 | B2 * | 7/2014 | Chiang et al. | 362/217.12 |
| 8,926,372 | B2 * | 1/2015 | McSweyn | 439/640 |
| 2008/0248672 | A1 * | 10/2008 | Yip | 439/300 |
| 2010/0277930 | A1 * | 11/2010 | Liu et al. | 362/374 |

* cited by examiner

*Primary Examiner* — Chandrika Prasad

(74) *Attorney, Agent, or Firm* — Francis C. Hand; Carella, Byrne et al

(57) ABSTRACT

The connector for connecting the LED tube to the electrical supply holder has a pair of metal connector pins each of which has a pair of electrical contact in two bores of a circumferential array of bore to allow the LED tube to be inserted into the electrical supply holder in each of several positions 90° apart. In a second embodiment, the connector has a pair of metal connector pins each of which has a semi-cylindrical wall against which a pin of the LED tube contacts. In this embodiment, the LED tube may be turned up to 360°.

12 Claims, 4 Drawing Sheets

CONNECTOR HAVING A CYLINDRICAL BODY WITH A FLANGE AND AN INTEGRAL INSERT WITH A RECTANGULAR BORE

This application claims priority of Provisional Patent Application No. 61/768,757 filed Feb. 25, 2013.

This invention relates to a multi-position LED tube connector.

As is known, many LED tubes are fabricated of an elongated housing that is provided with a pair of contact pins at one end in order to fit into an electrical supply holder for energization of the diodes of the tubes. Typically, these LED tubes are constructed such that the light emitted upon energization is uni-directional. As a result, should a need arise to adjust the direction of the emitted light, these LED tubes are unable to adjust to this situation.

It has also been known to adapt a LED tube so as to be mounted in different positions relative to an electrical socket.

For example, U.S. Pat. No. 7,052,171 describes a lighting assembly that has an elongated housing which contains a plurality of light emitting diodes with terminals at the ends of the housing to connect the lighting assembly into standard sockets of a fluorescent light fixture that has been modified to power the light emitting diodes. Use is made of a releasable holding mechanism that allows the housing to be rotated with respect to the sockets to aim the light is a desired direction and then hold the housing in that orientation.

Published US Patent Application 2010/0277930 describes a LED lamp structure includes a light-transmitting tube, a light-emitting module and two LED lamp adapters positioned on two opposite ends of the light-transmitting tube. Each adapter has parts that allow the electrode pins at the end of the LED tube to be rotated into different mounting positions.

However, the adapters that have been used to adjust the mounting of a LED tube in an electrical socket have been relatively complex and have required multiple parts that require manual manipulation in order to adjust the mounted position of a LED tube.

Accordingly, it is an object of the invention to provide a connector (or adapter) of relatively simple construction for adjusting an LED tube to different positions in order to redirect light emitted from the LED tube.

It is another object of the invention to be able to adjust the position of a LED tube in an electrical supply holder in a simple quick manner.

It is another object of the invention to be able to concentrate the light emitted from multiple LED tubes onto a selected surface.

Briefly, the invention provides a connector of one piece construction for mounting an end of an LED tube in an electrical supply holder and which enables the LED tube to be mounted in different angular positions within the electrical supply holder.

The connector comprises a cylindrical body of electrically inert material having a closed end, a radially directed flange at the closed end for abutting against the electrical supply holder, a receptacle integrally formed on the flange for fitting into the electrical supply holder; and an integral insert within the cylindrical body having a central bore of rectangular shape extending through the cylindrical body.

The multi-position LED tube connector is used to secure a LED tube at any position and to change the beam angle of the tube. With the help of two or more tubes, the lighting area can be increased by adjusting each tube to a different angle.

In one embodiment, the connector has a plurality of circumferentially disposed bores in the insert about the central bore for selectively receiving a pair of contact pins of an LED tube.

In addition, a pair of metal connector pins is mounted in the connector with each connector pin having a plate at one end disposed within the receptacle of the connector and a pair of electrical contacts at an opposite end disposed in an adjacent pair of the circumferentially disposed bores.

In this embodiment, the LED tube may be mounted in one of several positions 90° apart.

In another embodiment, the insert of the connector is of cylindrical shape with a plurality of radially directed struts supporting a centrally located tube having the central bore therein. In addition, a pair of metal connector pins is mounted in the connector with each connector pin having a plate at one end disposed within the receptacle of the connector and a semi-circular wall at the opposite end mating with an outside of the tube.

In this embodiment, the LED tube may be mounted in any position with the pins of the LED tube in contact with the semi-cylindrical walls of the connector pins.

These and other objects and advantages will become more apparent from the following detailed description taken in conjunction with the accompanying drawings wherein.

Figure 1:
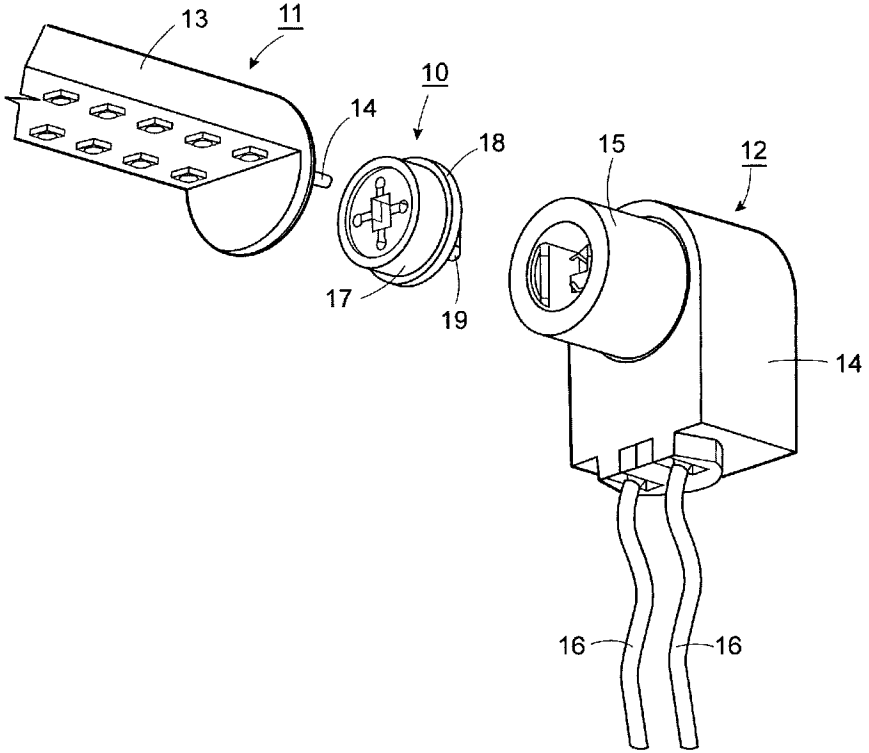
FIG. 1 illustrates an exploded view of a connector in accordance with the invention between an LED tube and an electrical supply holder.

Referring to FIG. 1, the connector (I.e. adapter) 10 is of one-piece construction and is constructed to enable mounting of an LED tube 11 in an electrical supply holder 12 (i.e. an electrical socket). In this embodiment, the LED tube 11 is of a conventional structure with a housing 13 from which two contact pins 14 project. In a similar manner, the electrical supply holder 12 is of a conventional structure with a housing 14 from which a socket 15 projects for receiving an electrical fixture and power lines 16 for energizing the socket 15.

The connector 10 is made of any suitable electrically inert material with a plastic being preferred.

Figure 2:
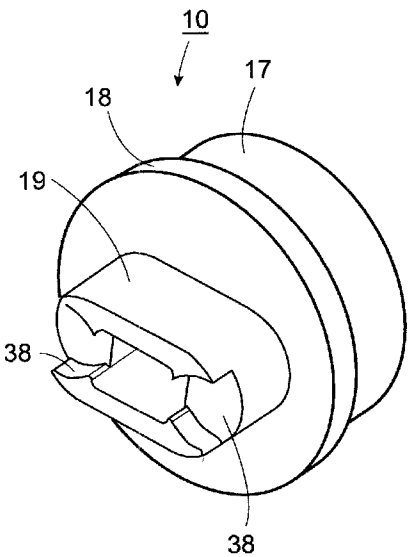
FIG. 2 illustrates a perspective view of the connector of FIG. 1 from the electrical supply holder end.

Referring to FIG. 2, the connector 10 has a cylindrical body 17 that is closed at one end by a radially directed flange 18. In addition, a receptacle 19 is integrally formed on the flange 18 for fitting into the socket 15 of the electrical supply holder 12. As illustrated in FIG. 1, the flange 18 is sized to abut against the socket 15 of the electrical supply holder 12 when the receptacle 19 is seated within the socket 15.

Figure 3:
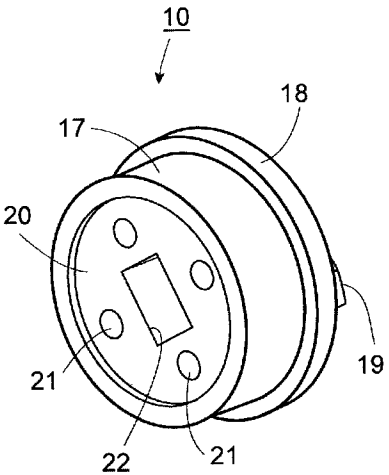
FIG. 3 illustrates a perspective view of the connector of FIG. 1 from the LED tube end.

Referring to FIG. 3, the connector 10 also has an integral insert 20 of cylindrical shape within the cylindrical body 17 that has a plurality of bores 21, e.g. four bores, disposed circumferentially about a centrally located bore 22 of rectangular shape. The centrally located bore 22 extends completely through the connector 10.

Figure 5:
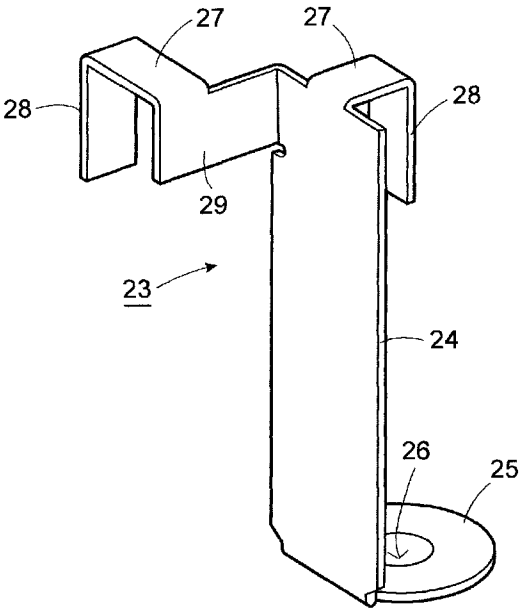
FIG. 5 illustrates a perspective view of one embodiment of a connector pin in accordance with the invention.
Figure 7:
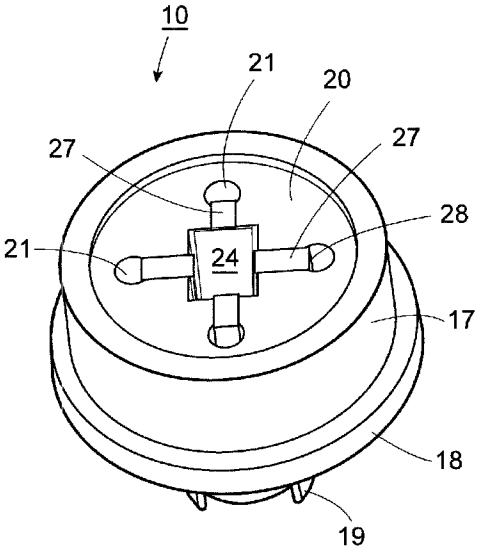
FIG. 7 illustrates a perspective view of the connector pin of FIG. 5 in place in the connector of FIG. 3.

Referring to FIGS. 1, 5 and 7, the connector 10 employs a pair of metal connector pins 23 for establishing electrical contact between the pins of the LED tube 11 and the socket 15 of the electrical supply holder 12.

As shown in FIG. 5, each connector pin 23 has a vertically disposed column 24, as viewed, of flat rectangular shape and a plate 25 of generally circular shape extending from the bottom of the column 24. The plate 25 includes a centrally located depression 26 that provides for an electrical contact with the socket 15 of the electrical supply holder 12.

Each connector pin 23 is made of sheet metal such that the plate 25 is bendable relative to the column 24.

In addition, each connector pin 23 has an outwardly extending strut 27 at the top end of the column 24 from which a plate 28 extends downwardly at the end. Each connector pin 23 also has a leg 29 extending perpendicularly outwardly from the top end of the column 24 on which a second strut 27 and depending plate 28 are mounted. As such, each connector pin 23 provides a pair of electrical contacts via the plates 28.

Referring to FIG. 7, each connector pin 23 is mounted in the connector 10 with a depending plate 28 inserted into a respective bore 21 and the column 24 inserted into the rectangular bore 22. As indicated, the two connector pins 23 provide two pairs of contacts for selectively receiving the contact pins 14 of the LED tube 11. That is, the LED tube 11 may be received in one of four positions 90° apart.

When mounted in the central bore 22 of the connector 10, the plate 25 of each connector pin 23 is bent and is sized to pass through the bore 22 from the top end, as viewed, to be exposed at the bottom end and then bent back into the position shown in FIG. 5 to provide a contact surface for the socket 15 of the electrical supply holder 12.

Figure 4:
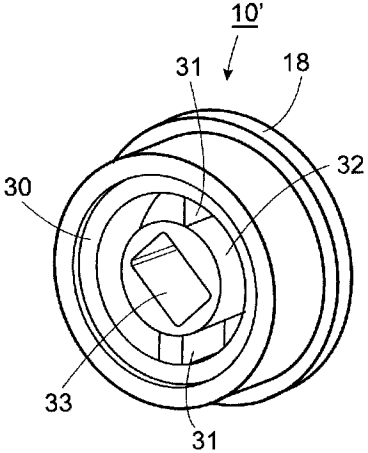
FIG. 4 illustrates a perspective view of a modified connector in accordance with the invention.
Figure 8:
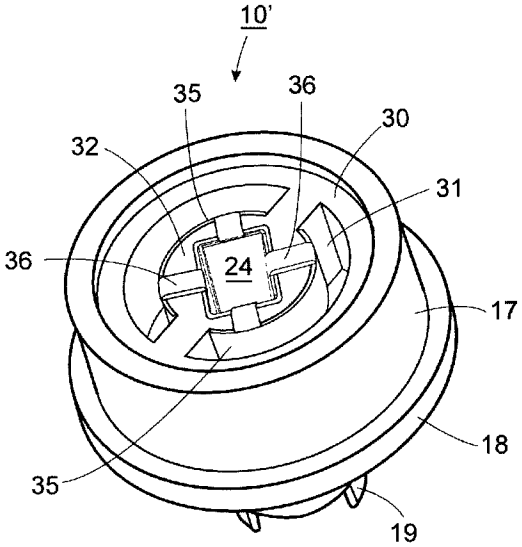
FIG. 8 illustrates a perspective view of the connector pin of FIG. 6 in place in the connector of FIG. 4.

Referring to FIGS. 4 and 8, wherein like reference characters indicate like parts as above, in another embodiment, the connector 10' has an integral insert 30 of cylindrical shape within the LED tube end of the cylindrical body 11 that has a pair of radially directed struts 31 supporting a centrally located tube 32. As shown, the tube 32 is formed with a bore 33 of rectangular shape.

Figure 6:
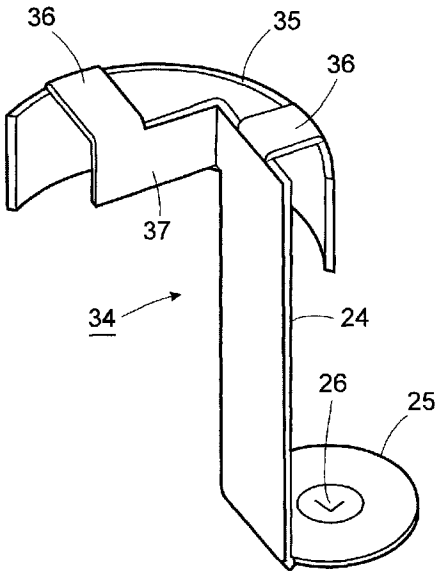
FIG. 6 illustrates a perspective view of a second embodiment of a connector pin in accordance with the invention.

Referring to FIGS. 6 and 8, wherein like reference characters indicate like parts as above, the connector 10' of FIG. 4 employs a pair of modified connector pins 34 to establish electrical contact with the contact pins 14 of the LED tube 11.

As shown in FIG. 6, each connector pin 34 is of an integral construction with a vertically disposed column 24 of flat rectangular shape and a plate 25 of generally circular shape extending from the bottom of the column 24. As indicated, the plate 25 has a centrally disposed depression 26 as above.

Each connector pin 34 also has a semi-circular wall 35 that is supported from the top of the column 24 via a strut 36 that extends between the column 24 and the wall 35 and a leg 37 and a second strut 36 that extends between the column 24 and wall 35. As shown, the leg 37 is perpendicular to the top of the column 24 such that the two struts 36 are radial to the wall 35.

The column 24 is provided with a greater width at the top end to keep the positive and negative farther apart.

Referring to FIG. 8, connector pin 34 of FIG. 6 is mounted in the connector 10' of FIG. 4 such that the semi-circular wall 35 of the connector pin 34 mates to the outside of the tube 32 of the insert 30. In addition, the struts 36 lie against the end face of the tube 32 while the column 24 extends through the tube 32 to position the plate 25 for contact with the electrical supply holder 12 as above.

Referring to FIG. 2, the receptacle 19 on the electrical supply holder end of the connector 10 is of oval shape with a pair of circular recesses 38 at opposite ends to receive the circular plates 25 of the connector pins 23, 34.

Referring to FIGS. 1 and 7, as noted above, the connector 10 provides for mounting of an LED tube in one of four positions 90° apart, e.g. 0°, 90°, 180°, 270° and 360°.

On the other hand, as shown in FIG. 8, the modified connector 10' provides a pair of arcuate slots about the tube 32 into which the contact pins 11 of the LED tube 11 may be inserted to contact with the semi-circular walls 35 of the connector pins 34. As such, the LED tube 11 may be oriented in multiple positions relative to the connector 10', e.g. from 0° to 360°, in order to change the angle of light emitted from the LED tube 11.

The invention thus provides a one piece connector of simple construction that allows an LED tube to be adjusted to different positions in order to redirect light emitted from the LED tube. Further, the connector allows the position of a LED tube to be adjusted in an electrical supply holder in a simple quick manner without a need to disassemble any parts of the connecter by simply turning the LED tube relative to the electrical supply holder (i.e. socket).

Further, the invention allows the mounted positions of multiple LED tubes to be adjusted in order to concentrate the light emitted from the LED tubes onto a selected surface.

What is claimed is:

1. A connector of one piece construction for mounting an end of an LED tube in an electrical supply holder, said connector comprising a cylindrical body of electrically inert material a radially directed flange at one end of said body for abutting against the electrical supply holder;

a receptacle integrally formed on said flange for fitting into the electrical supply holder; and an integral insert within said cylindrical body having a central bore of rectangular shape extending through said cylindrical body.

2. A connector as set forth in claim 1 further comprising a plurality of circumferentially disposed bores in said insert about said central bore for selectively receiving a pair of contact pins of an LED tube.

3. A connector as set forth in claim 1 wherein said insert is of cylindrical shape with a plurality of radially directed struts supporting a centrally located tube having said central bore therein.

4. In combination a one piece connector having a cylindrical body, a radially directed flange at one end of said body, a receptacle integrally formed on said flange; and an integral insert within said cylindrical body having a central bore of rectangular shape extending through said insert and said cylindrical body, and a pair of metal connector pins mounted in said connector, each said connector pin having a column extending through said central bore of said insert, a plate extending from one end of said column and disposed within said receptacle of said connector and at least one electrical contact at an opposite end of said column.

5. The combination as set forth in claim 4 wherein said plate of each connector pin is bendable relative to said column thereof.

6. The combination as set forth in claim 4 wherein said insert of said connector has a plurality of circumferentially disposed bores about said central bore and each said connector pin has a pair of electrical contacts received in an adjacent pair of said circumferentially disposed bores.

7. The combination as set forth in claim 6 further comprising an electrical supply holder having a housing with a projecting socket and power lines for energizing said socket, said socket having said body and said receptacle of said connector within said socket and said flange abutted against said socket.

8. The combination as set forth in claim 7 further comprising a LED tube having a housing at one end with a pair of contact pins projecting therefrom into a pair of oppositely disposed bores of said circumferentially disposed bores, each said contact pin being in contact with an electrical contact of a respective connector pin.

9. The combination as set forth in claim 4 wherein said insert is of cylindrical shape with a plurality of radially directed struts supporting a centrally located tube having said central bore therein and each said connector pin has a semi-circular wall mating with an outside of said tube.

10. The combination as set forth in claim 8 further comprising an electrical supply holder having a housing with a projecting socket and power lines for energizing said socket, said socket having said body and said receptacle of said connector within said socket and said flange abutted against said socket.

11. The combination as set forth in claim 9 further comprising a LED tube having a housing at one end with a pair of contact pins projecting therefrom, each said contact pin being in contact with said semi-cylindrical wall of a respective connector pin.

12. A connector of one piece construction for mounting an end of an LED tube in an electrical supply holder, said connector comprising a cylindrical body of electrical inert material;

a radially directed flange at one end of said body for abutting against the electrical supply holder;

a receptacle integrally formed on said flange for fitting into the electrical supply holder; and an integral insert within said cylindrical body having a central bore of rectangular shape extending through said receptacle and said cylindrical body and a plurality of bores disposed circumferentially about said central bore.

* * * * *